US007980544B2

(12) United States Patent
Baba et al.

(10) Patent No.: US 7,980,544 B2
(45) Date of Patent: Jul. 19, 2011

(54) HOLD FLAP FOR SHEET POSTPROCESSING APPARATUS

(75) Inventors: Kazuaki Baba, Tokyo (JP); Atsushi Kurabayashi, Tokyo (JP); Toru Yoshie, Tokyo (JP)

(73) Assignee: Max Co., Ltd., Tokyo (JP)

( * ) Notice: Subject to any disclaimer, the term of this patent is extended or adjusted under 35 U.S.C. 154(b) by 798 days.

(21) Appl. No.: 11/659,795

(22) PCT Filed: Aug. 12, 2005

(86) PCT No.: PCT/JP2005/014841

§ 371 (c)(1),
(2), (4) Date: Feb. 21, 2008

(87) PCT Pub. No.: WO2006/016676

PCT Pub. Date: Feb. 16, 2006

(65) Prior Publication Data

US 2008/0253820 A1 Oct. 16, 2008

(30) Foreign Application Priority Data

Aug. 12, 2004 (JP) ..... 2004-235638
Aug. 12, 2004 (JP) ..... 2004-235640

(51) Int. Cl.
*B65H 37/04* (2006.01)

(52) U.S. Cl. ..... 270/58.11; 270/58.16; 270/58.08; 271/220

(58) Field of Classification Search ..... 270/58.08, 270/58.11, 58.12, 58.16; 271/209, 220
See application file for complete search history.

(56) References Cited

U.S. PATENT DOCUMENTS

| | | | | |
|---|---|---|---|---|
| 4,029,309 | A | 6/1977 | Lynch et al. | |
| 5,083,761 | A | 1/1992 | Johdai et al. | |
| 5,478,062 | A | 12/1995 | Horiuchi et al. | |
| 6,120,020 | A | 9/2000 | Asao | |
| 6,145,825 | A | 11/2000 | Kunihiro et al. | |
| 6,209,864 | B1 * | 4/2001 | Taniguchi et al. | 271/220 |
| 6,412,774 | B1 * | 7/2002 | Saito et al. | 271/220 |
| 6,415,825 | B1 * | 7/2002 | Dupoiron et al. | 138/127 |
| 7,455,291 | B2 * | 11/2008 | Reeves et al. | 271/181 |
| 7,520,505 | B2 * | 4/2009 | Thomas et al. | 271/220 |

FOREIGN PATENT DOCUMENTS

| | | |
|---|---|---|
| EP | 0 820 948 | 1/1998 |
| EP | 0 960 744 | 12/1999 |
| EP | 1777186 A1 | 4/2007 |
| JP | U-61-59252 | 4/1986 |
| JP | A-62-56568 | 4/1987 |
| JP | 63-101270 | 5/1988 |

(Continued)

*Primary Examiner* — Patrick Mackey
(74) *Attorney, Agent, or Firm* — Morgan, Lewis & Bockius LLP

(57) ABSTRACT

A sheet hold flap 18 is arranged on an upper side of a vicinity of a rear end portion of a sheet table 7 to which a sheet is continuously supplied from a copier or the like. The sheet hold flap is switched to an upper initial position and a sheet holding position by a solenoid 17. There is carried out a control of holding a rear end portion of a sheet P by driving the sheet hold flap to the sheet holding position after taking in a sheet to the sheet table and returning the sheet hold flap to the initial position to escape from a sheet path in taking in a successive sheet. Sheet jamming by floating up the sheet is prevented by holding a sheet on the sheet table until immediately before taking in the successive sheet.

21 Claims, 13 Drawing Sheets

FOREIGN PATENT DOCUMENTS

| | | |
|---|---|---|
| JP | U-64-29347 | 2/1989 |
| JP | U-53170 | 4/1989 |
| JP | 1-127564 | 5/1989 |
| JP | A-1-134663 | 9/1989 |
| JP | A-2-132064 | 11/1990 |
| JP | A-9-240901 | 9/1997 |
| JP | A-11-314828 | 11/1999 |
| JP | A-2001-302068 | 10/2001 |
| JP | A-2002-241036 | 8/2002 |
| JP | 2004-99274 | 4/2004 |

* cited by examiner

HOLD FLAP FOR SHEET POSTPROCESSING APPARATUS

TECHNICAL FIELD

The present invention relates to a sheet postprocessing apparatus, particularly relates to a sheet postprocessing apparatus preventing sheet jamming at a sheet table.

BACKGROUND ART

There is a sheet postprocessing apparatus for carrying out a processing of stapling or punch hole forming, binder mounting or the like for sheets discharged from a copier or the like. The sheet postprocessing apparatus are constituted to be included in or connected to a copier and operate in cooperation with the copier in accordance with settings. After supplying one set of sheets from a copier or the like onto a sheet table, a postprocessing of stapling or the like is carried out.

JP-A-2002-241036 discloses an example of sheet aligning means for aligning a position of a sheet on a sheet table in a sheet postprocessing apparatus. The sheet postprocessing apparatus of JP-A-2002-241036 includes a pusher sliding from a transverse wall face of the table in a direction of a center of the table, and a rotating brush hung above the table for pushing a side face of a sheet introduced to the table by the pusher to align a position thereof in a transverse direction and aligning a position thereof in a longitudinal direction by sweeping a surface of the sheet by the rotating brush.

When a sheet receiving portion (sheet table) of the sheet postprocessing apparatus is arranged horizontally, a width of the apparatus is increased and therefore, it is general to arrange the sheet table to be erected skewedly. In this case, although a sheet supplied from a processing apparatus of a copier or the like at a prestage to the sheet postprocessing is dropped onto the inclined sheet table to be laminated thereon, the sheet passing through the copier or the like at the prestage is curled in almost all the cases to be brought into a state in which both front and rear ends thereof are warped.

Although when the sheet table is arranged horizontally, even when the sheet is curled, the sheet can be recovered to a flat attitude by its own weight and therefore, the problem described below is posed comparatively rarely, when the sheet table is arranged vertically, also the sheet is constituted by a vertical attitude and therefore, there is a case in which the curl is promoted by a gravitational force thereof and intervals of both front and rear end portions (both up and down end portions) of laminated sheets are increased to produce gaps therebetween. Further, when the gap is produced at an end portion on a rear side (upper side), there is a case in which a successively fed sheet advances to between sheets on the sheet table and cannot be moved down to a predetermined position to bring about sheet jamming.

DISCLOSURE OF THE INVENTION

According to one or more embodiments of the invention, a sheet postprocessing apparatus is provided with a sheet table, sheet aligning means for aligning longitudinal and transverse positions of a sheet taken in onto the sheet table, a sheet hold flap arranged on an upper side of a vicinity of a rear end portion of the sheet table, and a drive mechanism for switching the sheet hold flap to an initial position of separating the sheet hold flap from the table and a sheet hold position of making the sheet hold flap proximate to the table or bringing the sheet hold flap into contact therewith.

According to one or more embodiments of the invention, the sheet postprocessing apparatus is further provided with a sheet clamp provided at a front portion of the sheet table.

According to one or more embodiments of the invention, the sheet postprocessing apparatus is further provided with a sheet front end position restricting plate arranged on a lower side of the sheet table. The sheet aligning means comprises a positioning pusher for positioning the sheet in the transverse direction by being reciprocated between an initial position and a sheet aligning position, and a rotational type feed flap for bringing the sheet into contact with the sheet front end position restricting plate by rubbing an upper face of the sheet in a front direction.

According to one or more embodiments of the invention, the sheet postprocessing apparatus is further provided with controlling means for holding a rear end portion of the sheet by driving the sheet hold flap to the sheet holding position after taking in the sheet onto the sheet table and returning the sheet hold flap to the initial position to escape from a sheet path when a successive sheet is taken in.

According to one or more embodiments of the invention, the sheet is taken in onto the sheet table sheet by sheet, after loading one set of the sheets on the sheet table, a postprocessing of a binding processing by a staple, or a punch hole forming processing, or a binder mounting processing or the like is carried out for the one set of sheets on the sheet table.

According to one or more embodiments of the invention, the sheet postprocessing apparatus is further provided with controlling means for driving the sheet hold flap to the sheet holding position after taking in the sheet onto the sheet table and a sheet aligning processing by the sheet aligning means.

According to one or more embodiments of the invention, the sheet postprocessing apparatus is further provided with controlling means for driving the sheet hold flap to the sheet holding position and thereafter escaping the sheet hold flap to the initial position by a constant time period.

According to one or more embodiments of the invention, the sheet postprocessing apparatus is further provided with means for detecting an amount of feeding the sheet onto the sheet table by a sheet feeding mechanism and controlling means for returning the sheet hold flap from the sheet holding position to the initial position based on a detected value by the feed amount detecting means. The controlling means returns the sheet hold flap to the initial position when the taken-in sheet reaches immediately before the sheet hold flap.

According to one or more embodiments of the invention, the sheet postprocessing apparatus is further provided with means for controlling a timing of returning the sheet hold flap to the initial position in accordance with a number of sheets on the sheet table. The means delays a return start timing in accordance with an increase in the number of sheets and makes a time period of from starting to take in the sheet to returning the sheet hold flap to the initial position constant regardless of the number of sheets on the sheet table.

According to one or more embodiments of the invention, the sheet postprocessing apparatus is further provided with optical detecting means or mechanical detecting means for detecting a curl amount of the sheet taken in onto the sheet table, and means for controlling to operate the sheet hold flap based on a detected value of the curl amount. The means carries out a sheet holding operation of the sheet hold flap when the curl amount of the sheet is equal to or larger than a certain reference value.

According to one or more embodiments of the invention, a sheet postprocessing apparatus is provided with a sheet table, sheet aligning means for aligning longitudinal and transverse positions of a sheet taken in onto the sheet table, and a clamp mechanism for clamping a front end portion of the aligned sheet for a postprocessing. At each time of taking in one sheet of the sheets onto the sheet table, a clamp operation by the clamp mechanism is carried out and the clamp is released when a successive sheet is taken in.

According to one or more embodiments of the invention, the clamp mechanism is provided at a front portion of the sheet table.

According to one or more embodiments of the invention, the sheet postprocessing apparatus is further provided with a sheet hold flap arranged on an upper side of a vicinity of a rear end portion of the sheet table.

According to one or more embodiments of the invention, the sheet is taken in onto the sheet table sheet by sheet, one set of the sheets are loaded onto the sheet table, thereafter, a postprocessing of a binding processing by a staple, or a punch hole forming processing, or a binder mounting processing or the like is carried out for the one set of sheets on the sheet table.

According to one or more embodiments of the invention, the sheet postprocessing apparatus is further provided with controlling means for carrying out a clamp operation by the clamp mechanism at each time of taking in a certain set number of sheets of the sheets onto the sheet table.

According to one or more embodiments of the invention, the sheet postprocessing apparatus is further provided with controlling means for skipping a clamp operation in accordance with a number of sheets of the sheets taken in onto the sheet table. An interval of the clamp operation is reduced in accordance with an increase in the number of sheets.

According to the sheet postprocessing apparatus, when the number of sheets of the sheets on the sheet table is small, the clamp operation is carried out by once per several sheets, the clamp operation is carried out further frequently as increasing the number of sheets of the sheets, a number of times of the clamp operation as a whole can be saved, and performance of preventing the sheet from being floated up when the number of sheets of the sheets is increased is not deteriorated.

According to one or more embodiments of the invention, after clamping the sheet, the clamp is released after an elapse of a constant time period.

According to the sheet post processing apparatus, a speed of total steps can be constituted by high speed by setting the clamp to be released before detecting an operation of drawing and detecting the sheet.

According to one or more embodiments of the invention, the sheet postprocessing apparatus is further provided with a film provided at a lower face of the clamp of the clamp mechanism, hung to an upper face of the sheet table, and guiding a front end of the sheet taken in to the sheet table onto the sheet table.

According to the sheet post processing apparatus, the front end of the sheet taken in onto the sheet table is butted to the film hung from the clamp to the lower side to be guided onto the sheet table and therefore, the sheet can firmly be set onto the sheet table without warping back the front end of the sheet to an upper side to ride over a front wall of the sheet table.

According to one or more embodiments of the invention, the clamp of the clamp mechanism is arranged at a position which does not cover a punch hole of a punched sheet on the sheet table, and both left and right end portions of the clamp are projected to vicinities of a sheet position restricting plate arranged at a front end of the sheet table.

According to the sheet post processing apparatus, the both left and right end portions of the sheet clamp are extended to vicinities of the sheet position restricting plate arranged at the front end of the sheet table and therefore, similar to the operation of the film, the sheet can firmly be set onto the sheet table without riding over the front wall of the sheet table.

Other aspects and advantages of the invention will be apparent from the following description and the appended claims.

DESCRIPTION OF REFERENCE NUMERALS AND SIGNS

Figure 1:
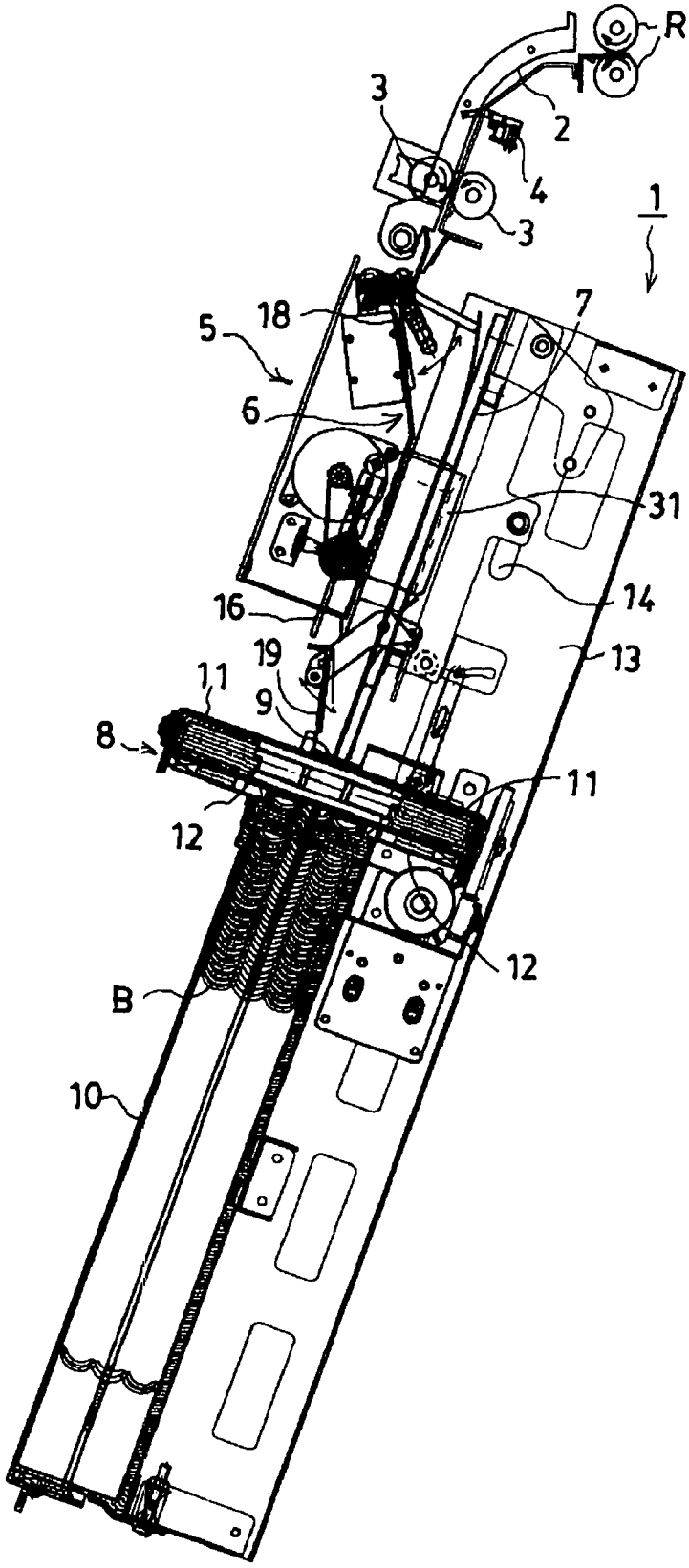
FIG. 1 is a side view of a bind processing apparatus.

1 . . . bind processing apparatus
3 . . . sheet feeding roller
4 . . . sheet detecting sensor
5 . . . sheet guide unit
6 . . . sheet guide
7 . . . sheet table
8 . . . bind mechanism portion
9 . . . sheet front end position restricting plate
10 . . . binder cartridge
16 . . . rotational type feed flap
18 . . . sheet hold flap
19 . . . sheet clamp
22 . . . rubber piece
23 . . . low friction resin film
31 . . . positioning pusher
32 . . . slide guide shaft
33 . . . gear
34 . . . crank pin
35 . . . cam groove
36 . . . stepping motor
41 . . . reflecting type photosensor
42 . . . light emitting portion
43 . . . lever
44 . . . light blocking plate
45 . . . photointerrupter

BEST MODE FOR CARRYING OUT THE INVENTION

Embodiments of the invention will be explained in reference to the drawings as follows.

Embodiment 1

Figure 2:
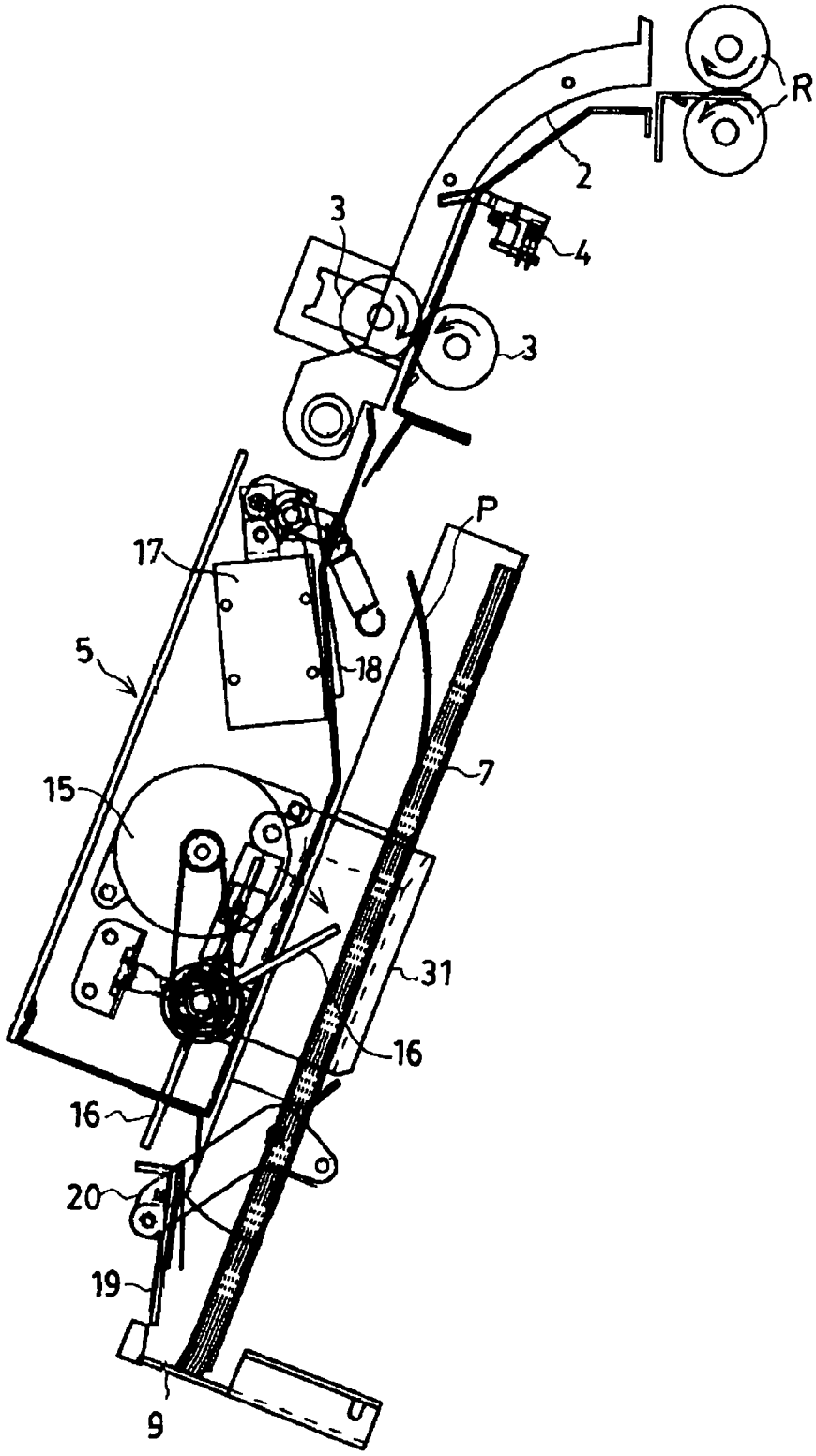
FIG. 2 is a view enlarging a portion of FIG. 1.

FIG. 1 and FIG. 2 show a bind processing apparatus 1 for mounting a ring binder to sheets subjected to a punch hole processing to bind as an example of a sheet postprocessing apparatus. A roller R shown at a topmost portion in FIG. 1 is a sheet discharging roller of a copier, a punching apparatus or the like at a prestage, and a sheet fed by the sheet discharging roller R is moved down in a skewed lower direction along a sheet guide 2 to reach a sheet feeding roller 3. A sheet detecting sensor 4 is arranged immediately before the sheet feeding roller 3, and 1 cycle of a binding processing comprising sheet aligning and binder mounting is carried out from when the sheet detecting sensor 4 detects the sheet. The sheet drawn by the sheet feeding roller 3 is dropped by its own weight by being guided onto a sheet table 7 by a sheet guide 6 at inside of a sheet guide unit 5, and is brought into contact with a sheet front end position restricting plate 9 of a front face (an upper face in the drawing of a bind mechanism portion 8 arranged on a lower side of the sheet table 7.

A back face of the bind mechanism portion 8 is connected with a binder cartridge 10, inside of the binder cartridge 10 is charged with a ring binder B in a shape of dividing a ring in three, in a state of being laminated in an up and down direction, and the ring binder B is pushed up to an upper side by a spring and a pusher (not illustrated) at inside of the binder cartridge 10. The bind mechanism portion 8 is provided with respective up and down pairs of pushers 11 and slide type separators 12, and a frontmost row of the ring binder B is separated from a successive row of the ring binder by closing the up and down separators 12.

After feeding one set of punched sheets onto the sheet table 7, the sheet front end position restricting plate 9 is moved down by a motor (not illustrated) to escape from the front face of the bind mechanism portion 8, the sheet table 7 is driven to move forward along a guide groove 14 of a frame 13, and lower end faces of the sheets P on the sheet table 7 are brought into contact with a front face of the binder cartridge 10. At this occasion, punch holes of the sheets are brought to between up and down pushers 11, the up and down pushers 11 are driven to close a ring portion of the ring binder B, and a recessed portion and a projected portion of front ends of the ring portion opposed to each other are fitted together at inside of the punch hole of the sheets to be fixed in a ring-like shape to bind the sheets P. Further, after the binding processing, the sheets P are discharged by swinging a lower portion of the sheet table 7 to an upper side by constituting a fulcrum by an upper portion thereof although illustration thereof is omitted.

Figure 3:
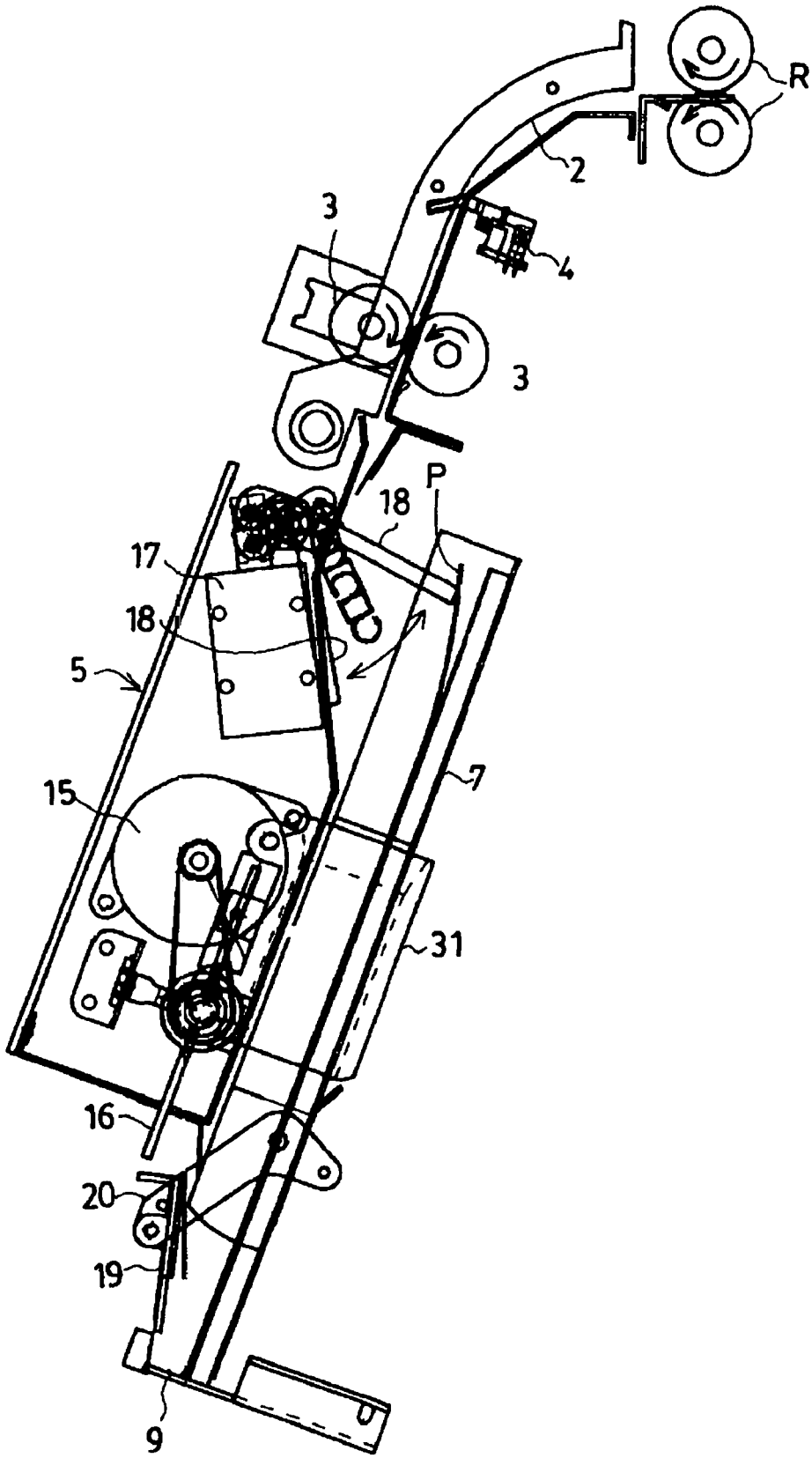
FIG. 3 is a view enlarging a portion of FIG. 1.

FIG. 2 and FIG. 3 are views enlarging a portion of FIG. 1, a lower portion of inside of the sheet guide unit 5 of an opening/closing type arranged on the sheet table 7 is provided with a soft rotational type feed flap 16 for sweeping the sheet P to a lower side by being driven to rotate by a motor 15. An upper side of the rotational feed flap 16 is provided with a sheet hold flap 18 for pressing a rear end portion of the sheet P to the sheet table 7 by being rotated by a solenoid 17. The rotational type feed flap 16 is rotated by one rotation or a half rotation to rub an upper face of the sheets P to a front side at each time of feeding the sheet to bring the sheet P into contact with the sheet front end position restricting plate 9. The sheet hold flap 18 on an upstream side thereof carries out a reciprocating operation for moving down and moving up relative to the sheet table 7 and presses the rear portion of the sheet P to the sheet table 7 to thereby prevent the sheet from floating up as shown by FIG. 3. A sheet clamp 19 is provided at a front portion (lower portion in the drawing) of the sheet table 7, the sheet is moved down and moved up relative to the sheet table 7 by a link mechanism (not illustrated) to clamp the sheet on the sheet table 7.

Figure 4:
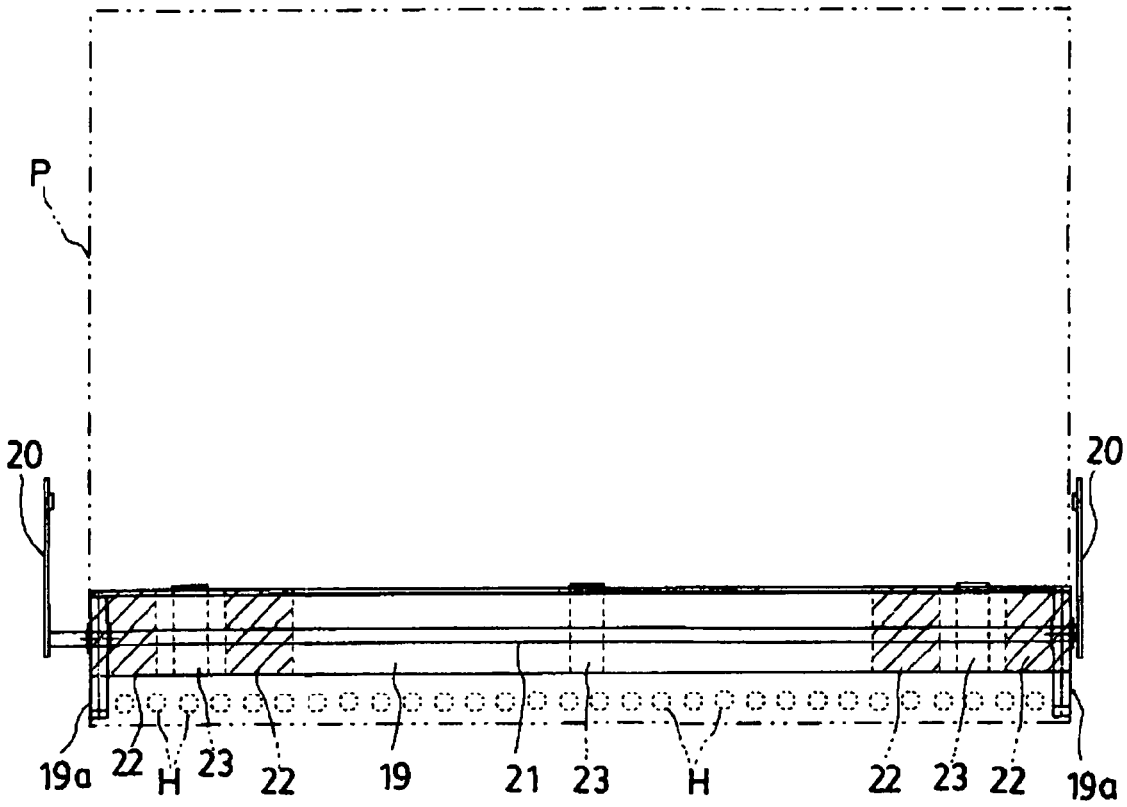
FIG. 4 is a plane view of a sheet clamp.
Figure 5:
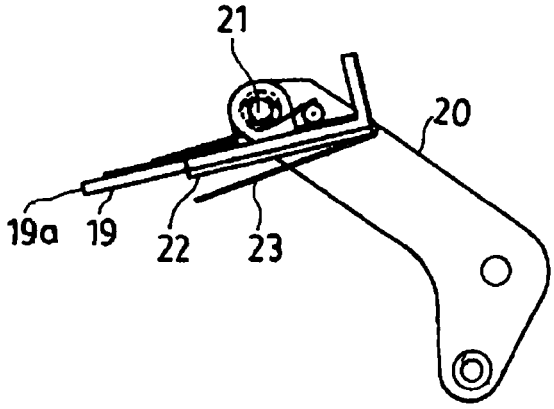
FIG. 5 is a side view of the sheet clamp.

FIG. 4 and FIG. 5 show a sheet clamp mechanism, levers 20 arranged on both left and right sides of the sheet table 7 are connected by a shaft 21, and the sheet clamp 19 extended over an entire width of the sheet table 7 are pivotably attached to the shaft 21. Both end portions 19*a* of the sheet clamp 19 are projected frontward from other portion (downward therefrom in FIG. 4) and extended to vicinities of the sheet front end position restricting plate 9 shown in FIG. 1, guide the front end of the sheet fed from the upper side so as not to ride over the sheet front end position restricting plate 9 to be deviated therefrom, and prevent a portion other than the two left and right end portions 19*a* from closing punch holes H of the punched sheet P on the sheet table.

Both left and right end portions of a back face of the sheet clamp 19 are pasted with respective two pieces of rubber pieces 22, and low friction resin films 23 of MYLAR® films or the like are arranged between the respective left and right pairs of the rubber pieces 22 and a center thereof. One end of the low friction resin film 23 is adhered to an upstream side edge portion of the sheet clamp 19, an end portion thereof on a downstream side is hung down, and when the front end of the sheet is brought into contact with the low friction resin film 23, the front end is guided on the sheet table 7 along the low friction resin film 23.

Figure 6:
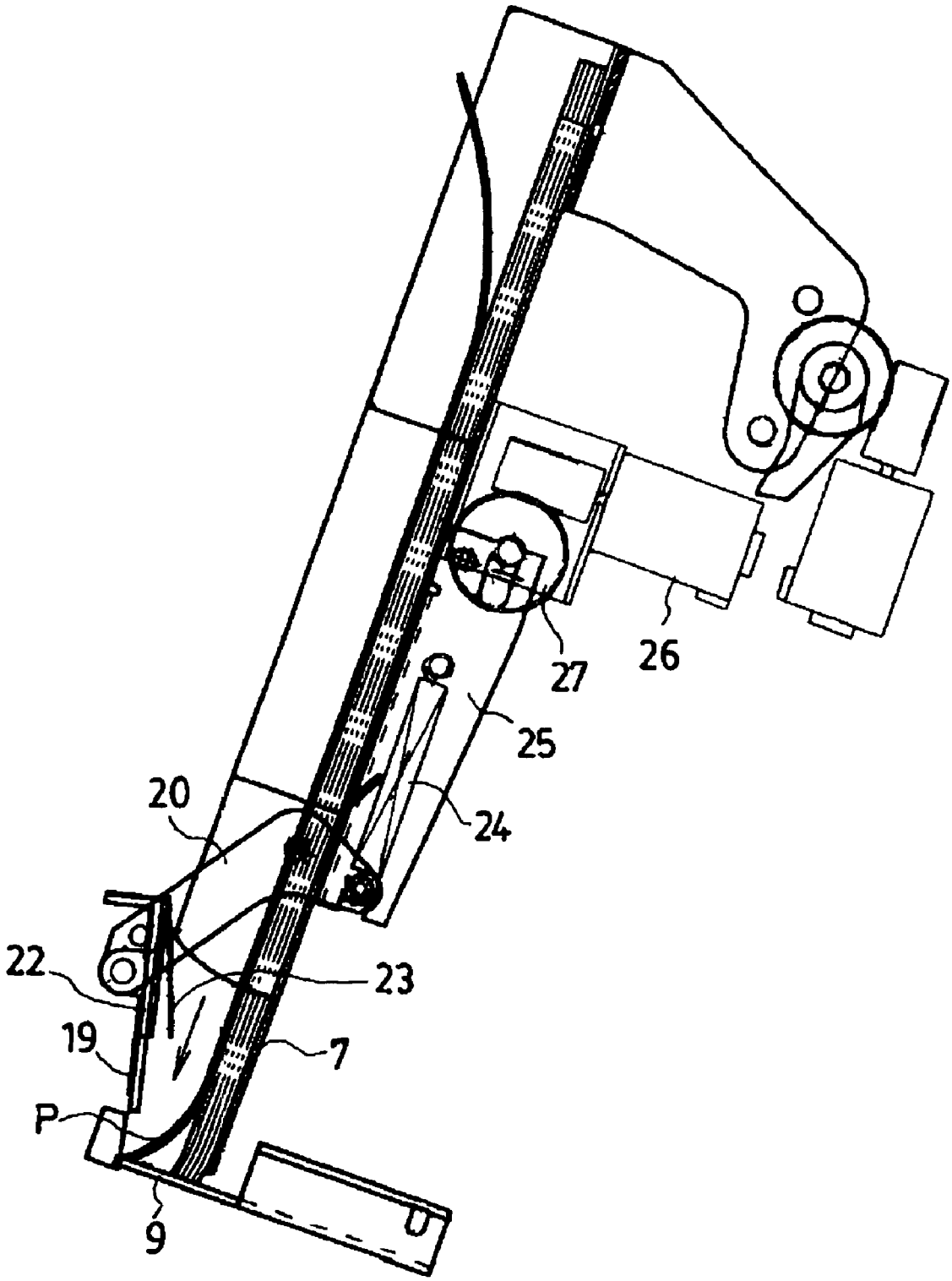
FIG. 6 is a side view of a sheet table and a sheet clamp mechanism.
Figure 7:
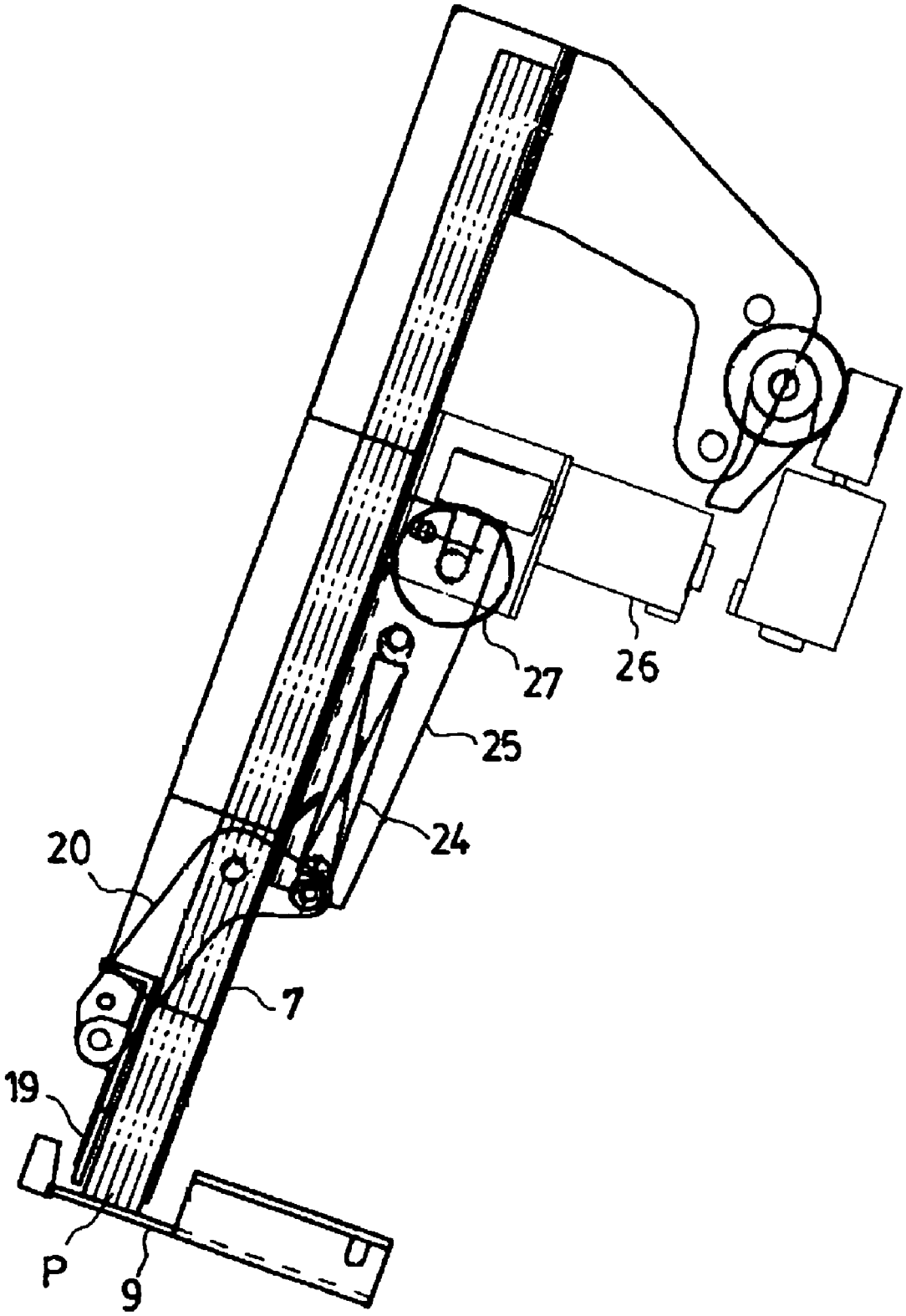
FIG. 7 is a side view of the sheet table and the sheet clamp mechanism.

FIG. 6 shows an open state of moving up the sheet clamp 19, FIG. 7 shows a clamp state of moving down the sheet clamp 19. The lever 20 for supporting the sheet clamp 19 is connected to a link 25 by way of a tension coil spring 24, the link 25 is connected to a crankshaft 27 driven by a motor 26, and the sheet clamp 19 is moved up or moved down relative to the sheet table 7 in accordance with a direction of rotating the motor 26 and the crankshaft 27.

Since the tension coil spring 24 is interposed between the lever 20 and the link 25, regardless of a thickness of the sheets P on a the sheet table 7, the sheet clamp 19 can be brought into press contact with the sheets P. When the sheet clamp 19 is moved down, the rubber piece 22 is brought into press contact with the sheet to hold the sheet, since the low friction resin film 23 provided to be aligned with the rubber piece 22 is thinner than the rubber piece 22, the low friction resin film 23 does not hinder the rubber piece 22 from being brought into press contact with the sheet.

Figure 8:
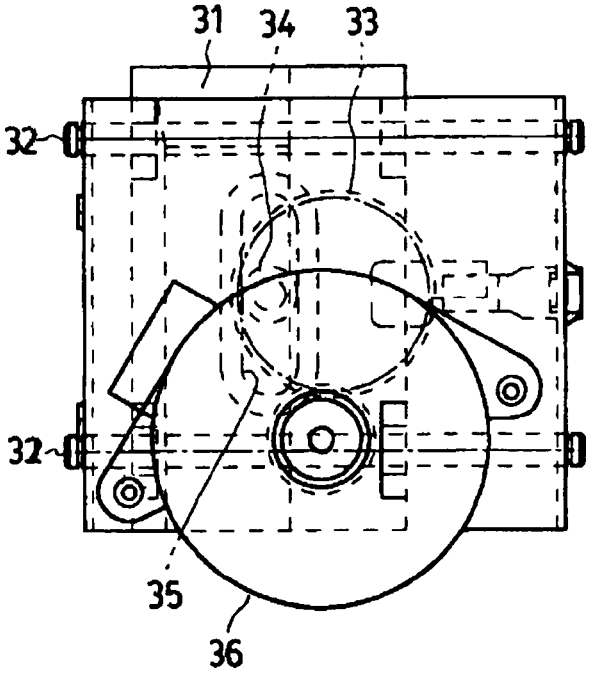
FIG. 8 is a plane view of a positioning pusher.
Figure 9:
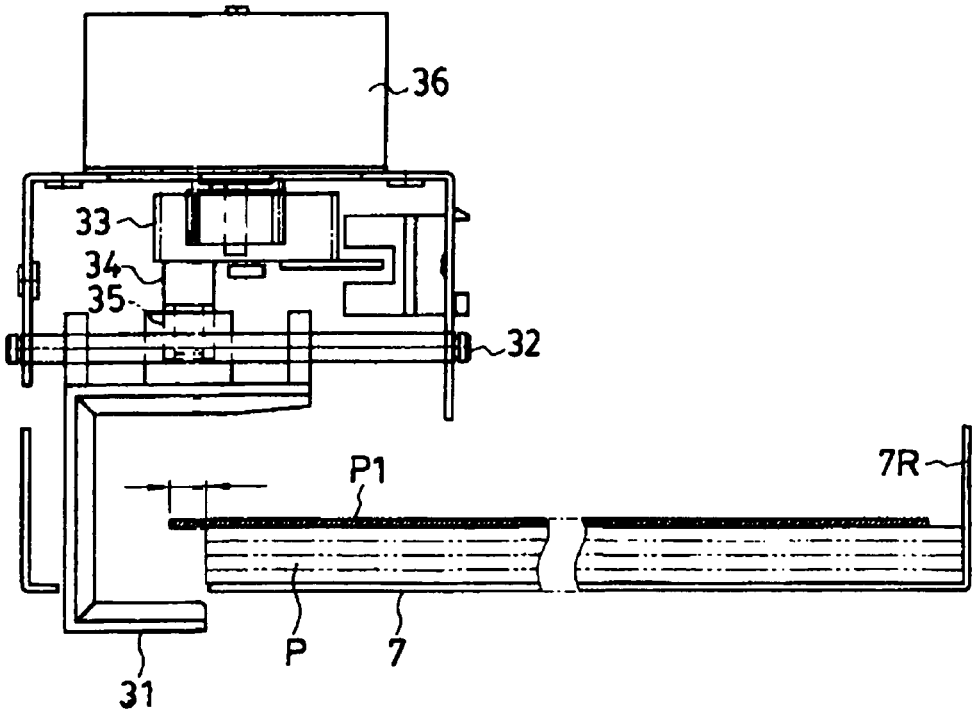
FIG. 9 is a front view of the positioning pusher.
Figure 10:
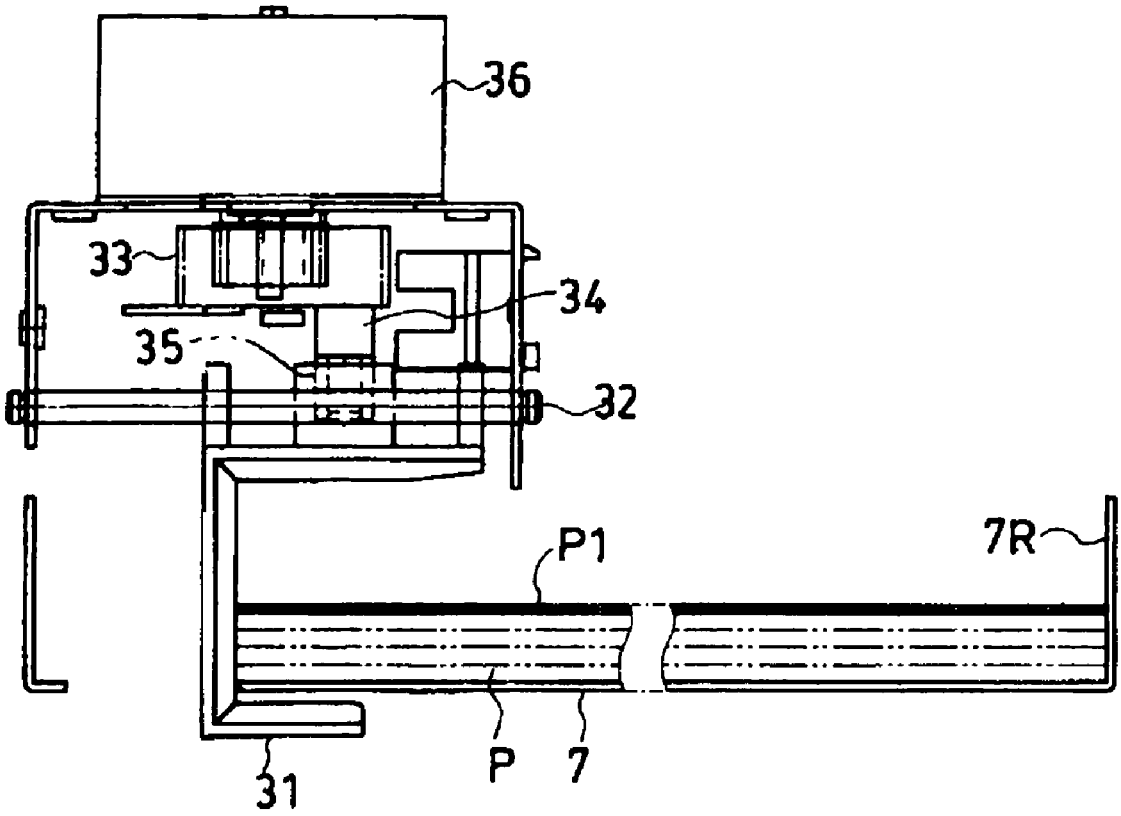
FIG. 10 is a front view of the positioning pusher.

FIG. 8 and FIG. 9 show a sheet aligning mechanism for positioning the sheet in a transverse direction by a positioning pusher 31 arranged on a side of the sheet table 7. The positioning pusher 31 is mounted to a slide guide shaft 32, a crank pin 34 provided at a gear 33 is engaged with a linear cam groove 35 formed at an upper portion of the positioning pusher 31, and by driving the gear 33 by a stepping motor 36, the positioning pusher 31 is reciprocally moved between an initial position on a left end and a sheet aligning position on a right side in accordance with a direction of rotating the stepping motor 36. An interval between the positioning pusher 31 at the sheet aligning position and a right side wall face 7R of the sheet table 7 is controlled to coincide with a width dimension of the sheet P.

FIG. 9 shows a case in which a sheet P1 fed onto the sheet table 7 is shifted transversely, and by sliding the positioning pusher 31 to the sheet aligning position after introducing the sheet to push the sheet P1 to the right side wall face 7R of the sheet table 7, the position of the sheet P1 in the transverse direction is corrected, and after aligning the sheet, the positioning pusher 31 returns to a left standby position.

Figure 11:
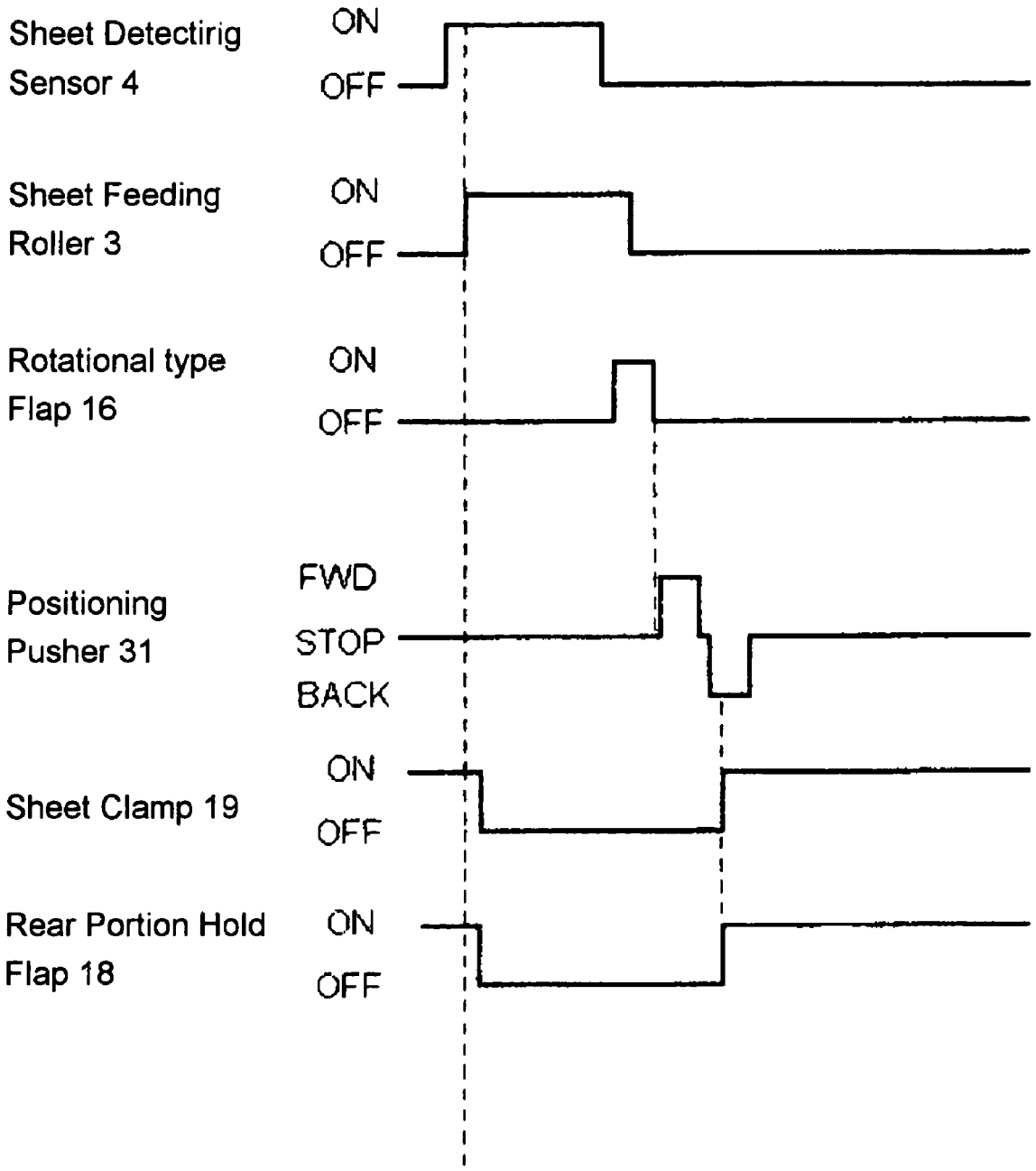
FIG. 11 is a timing chart showing an example of timings of operating a sheet aligning mechanism.

FIG. 11 shows an operational procedure of the above-described respective mechanisms, when the sheet detecting sensor 4 shown in FIG. 1 detects the sheet, the sheet feeding roller 3 is started, the sheet hold flap 18 and the sheet clamp 19 are moved up from move-down positions (ON) to return to initial positions (OFF) to escape from a sheet path. A timing of escaping the sheet hold flap 18 and the sheet clamp 19 from the sheet path may be controlled by either of a control by time, a control based on an amount of rotating the sheet feeding roller or the sheet feeding roller drive motor, and the sheet hold flap 18 and the sheet clamp 19 are escaped immediately before the front end of sheet reaches the sheet hold flap 18.

After an elapse of a set time period (time period until the sheet is fed to the sheet table) from starting the sheet feeding roller 3, or when it is detected that the sheet has been finished to feed from an amount of rotating the sheet feeding roller 3, the rotational type feed flap 16 is started to rotate by one rotation, the sheet is moved down to a predetermined position, thereafter, the positioning pusher 31 is started to correct the position of the sheet in the transverse direction. The positioning pusher 31 is brought into a return stroke by reversing a direction thereof after reaching the sheet aligning position, when the sheet is released from being pressed by the positioning pusher 31, simultaneously with moving down the sheet clamp 19 to press the front end of the sheet to the sheet table 7, the sheet hold flap 18 is moved down to press a rear end portion of the sheet to the sheet table 7, and the sheet clamp 19 and the sheet hold flap 18 await for supply of a successive sheet under the state.

Figure 12:
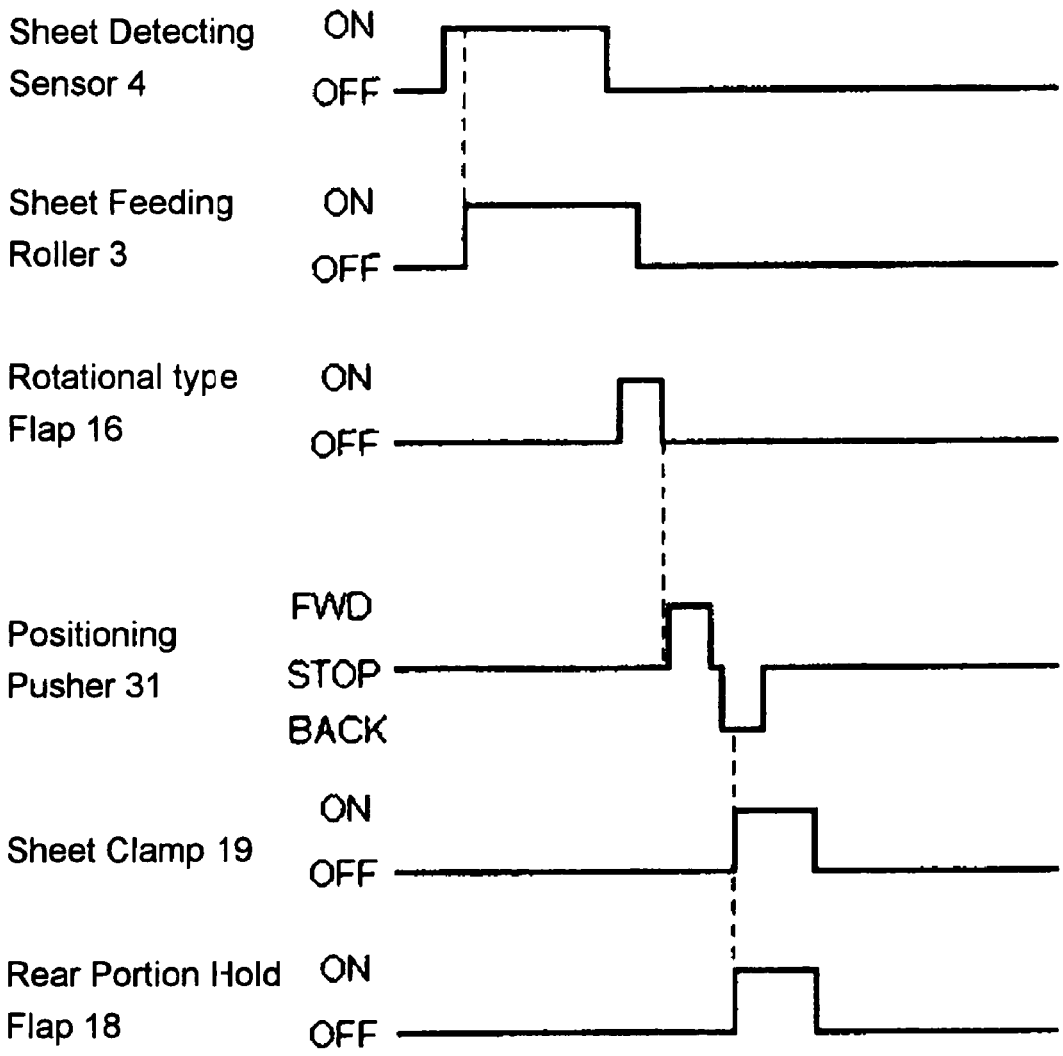
FIG. 12 is a timing chart showing an example of timings of operating the sheet aligning mechanism.

Further, the sheet clamp 19 and the sheet hold flap 18 may be controlled to return to the initial positions (OFF) after a certain set time period as shown by FIG. 12 instead of being controlled to continue the holding operation until a successive sheet is supplied. Further, the holding operation of the sheet clamp 19 may be carried out by a unit of a plurality of sheets, for example, once per 10 sheets other than being carried out at each sheet, further, the operation may be controlled to shorten an interval of the holding operation in steps as the thickness of the sheets on the sheet table increases, for example, once per 10 sheets up to 50 sheets, once per 3 sheets up to 80 sheets after exceeding 50 sheets, every time per sheet when 80 sheets are exceeded in accordance with a number of sheets of one set of the sheets (sheet number information is acquired from a processing apparatus at a prestage). In this case, the holding operation is thinned in a case of a small number of sheets accompanied by a comparatively inconsiderable concern of sheet jamming, and effects of promoting an operational efficiency, high speed formation of an operational time period and the like can be expected.

Further, a final state of sheet aligning can further be improved by increasing an amount of feeding the positioning pusher 31 more than a normal value thereof and reducing a moving speed when a final sheet of one set of sheets is taken in.

Further, a stroke between the sheet holding position and the initial position of the sheet hold flap 18 differs by the thickness of the sheets on the sheet table 7 and therefore, when there is provided means for controlling a timing of driving the sheet hold flap 18 in accordance with a number of the sheets on the sheet table 7, and the timing for returning to the initial position is constituted to be delayed in accordance with an increase in the number of sheets (counted by way of the sheet detecting sensor 4), regardless of the number of sheets, the sheets on the sheet table can be held until the taken-in sheet comes to immediately before the sheet hold flap 18, and sheet jamming can further firmly be prevented.

Embodiment 2

Figure 13:
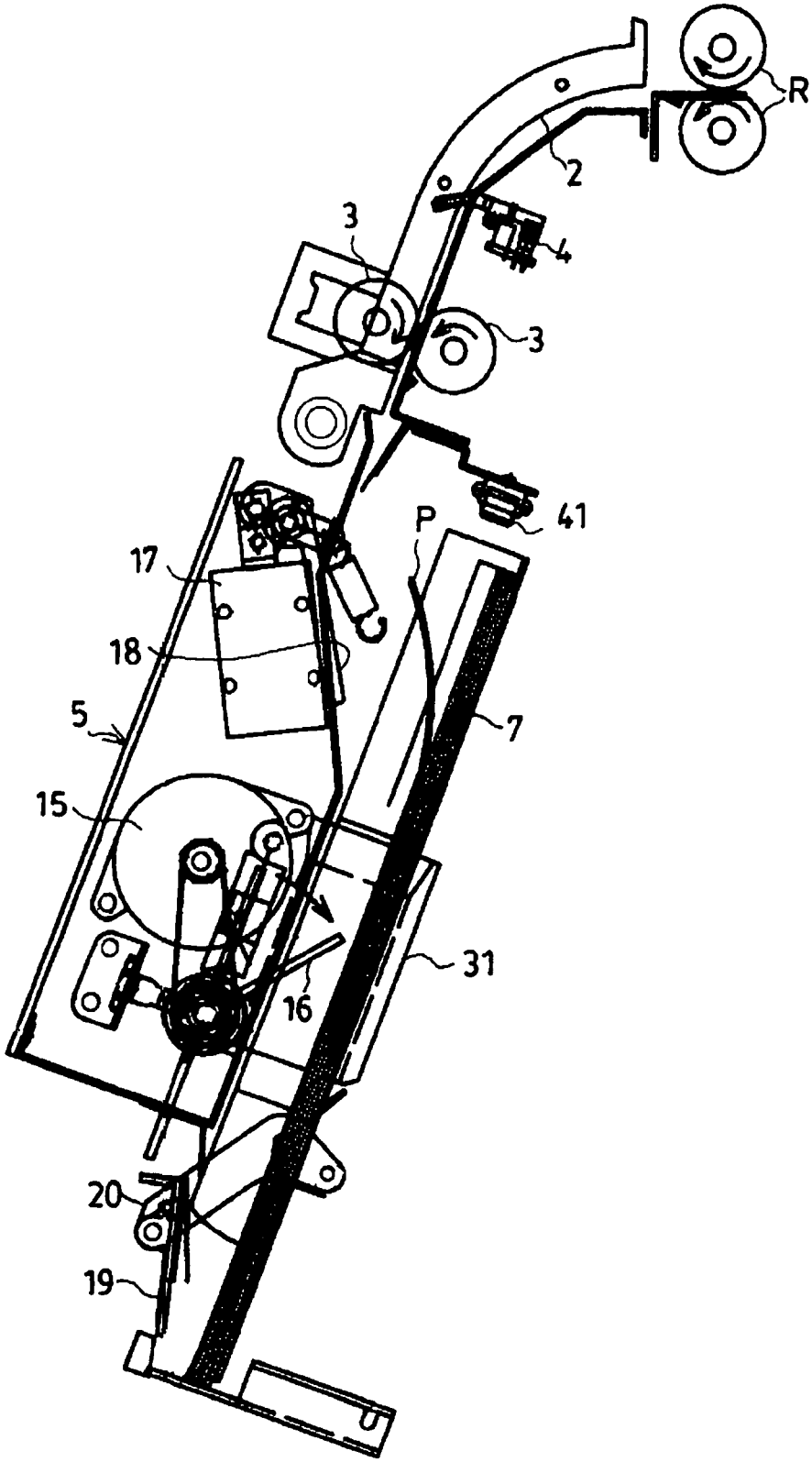
FIG. 13 is a side view of a portion of the sheet table.
Figure 14:
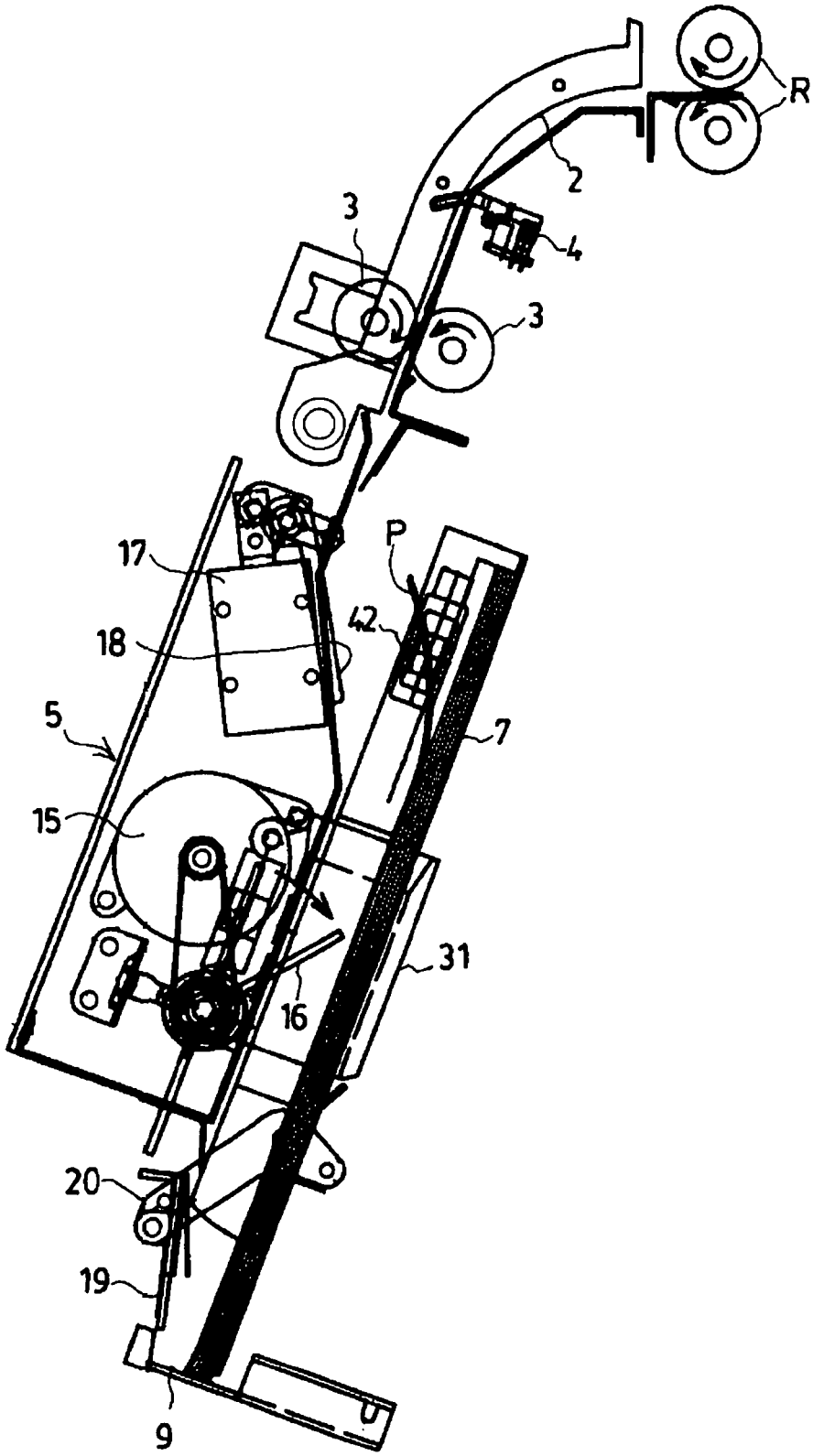
FIG. 14 is a side view of a portion of the sheet table.
Figure 15:
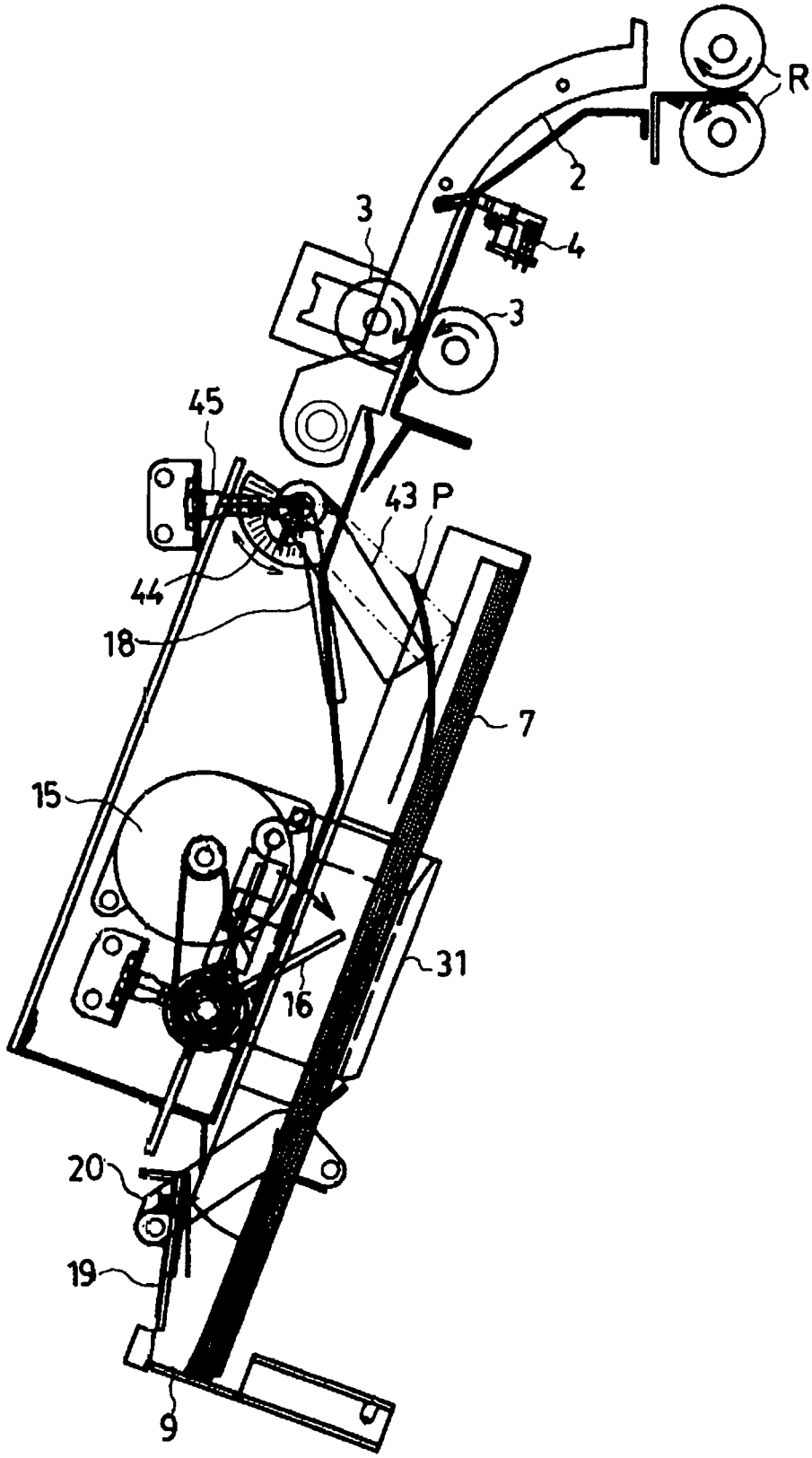
FIG. 15 is a side view of a portion of the sheet table.

Although according to Embodiment 1, at each time of feeding a sheet onto the sheet table 7, the sheet hold flap 18 holds the sheet, FIG. 13 through FIG. 15 shows an embodiment of omitting the holding operation of the sheet hold flap 18 when the sheet is not curled.

In FIG. 13, a reflection type photosensor 41 is provided upward from a rear end (upper end in the drawing) of the sheet table, and an optical axis of the reflection type photosensor 41 is made to be in parallel with the sheet table 7, and higher than a height of a maximum number of sheets. In feeding sheet P onto the sheet table 7, when a rear portion of the sheet P is curled to an upper side, light emitted by a light emitting portion of the reflection type photosensor 41 is reflected by the sheet to return to a light receiving portion thereof. When the light receiving portion receives reflected light, it is recognized that the sheet is curled, the sheet hold flap 18 carries out the above-described holding operation, and when reflected light is not received, it is recognized that the sheet is not curled, and the sheet hold flap 18 does not carry out the holding operation. Thereby, when the sheet is not curled, by omitting the holding operation, a time period for shifting to a successive postprocessing step can be shortened and the step can be constituted by high speed.

Further, as shown by FIG. 14, means for detecting curl of a sheet may be constructed by a constitution of arranging a light emitting portion 42 at an inner face of a rear portion of one side wall of the sheet table, and arranging a light receiving portion (not illustrated) at an inner face of a rear portion of other side wall to make the light emitting portion 42 and the light receiving portion opposed to each other.

Further, according to an example shown in FIG. 15, a lever 43 is provided coaxially with the sheet hold flap 18 and a guide blocking plate 44 attached to the lever 43 is interposed by a photointerrupter 45 and the lever 43. The light blocking plate 44 is provided with a plurality of slits, in accordance with pivoting the lever 43, the slits are detected by the photointerrupter 45 to count a number of slits. When the sheet P is curled, the lever 43 is pushed up and the number of counting the slits is increased and therefore, presence/absence of the curl of the sheet P can be recognized.

Further, the invention is not limited to the above-described embodiments but can variously be changed or modified within the technical range of the invention, and the invention naturally covers the modifications and changes.

The application is based on Japanese Patent Application (Japanese Patent Application No. 2004-235638) filed on Aug. 12, 2004 and Japanese Patent Application (Japanese Patent Application No. 2004-235640) filed on Aug. 12, 2004, and contents of which are incorporated herein by reference.

Industrial Applicability

According to one or more embodiments of the invention, a sheet postprocessing apparatus is constituted such that at each time of supplying a sheet onto a sheet table, a rear end portion of the sheet on the sheet table is held by a sheet hold flap, when a successive sheet is taken in, the sheet hold flap is detached therefrom. Therefore, there is resolved a concern that by floating up sheets on the sheet table, a successive sheet is brought to between the sheets on the sheet table to bring about sheet jamming, or an order of loading the sheets becomes erroneous.

Further, according to one or more embodiments, after finishing a sheet aligning processing by sheet aligning means for correcting longitudinal and transverse positional shifts of a sheet, the sheet is held by the sheet hold flap and therefore, the sheet aligning processing is not hindered.

Further, according to one or more embodiments of the invention, when a sheet is taken in onto the sheet table of the sheet postprocessing apparatus, a clamp mechanism clamps the sheet and release the sheet from being clamped when a successive sheet is taken in. Therefore, the sheet on the sheet table is corrected from being floated up and sheet jamming can be prevented without providing float up correcting means separately from the clamp.

The invention claimed is:

1. A sheet postprocessing apparatus comprising:

a sheet table;

sheet aligning means for aligning longitudinal and transverse positions of a sheet taken in onto the sheet table;

a sheet hold flap arranged on an upper side of a vicinity of a rear end portion of the sheet table;

a drive mechanism for switching the sheet hold flap to an initial position of separating the sheet hold flap from the table and a sheet hold position of making the sheet hold flap proximate to the table or bringing the sheet hold flap into contact therewith; and means for controlling a timing of returning the sheet hold flap to the initial position in accordance with a number of sheets on the sheet table, wherein the means delays a return start timing in accordance with an increase in the number of sheets, and makes a time period of from starting to take in the sheet to returning the sheet hold flap to the initial position constant regardless of the number of sheets on the sheet table.

2. The sheet postprocessing apparatus according to claim 1, further comprising:

a sheet clamp provided at a front portion of the sheet table.

3. The sheet postprocessing apparatus according to claim 1, further comprising:

a sheet front end position restricting plate arranged on a lower side of the sheet table;

wherein the sheet aligning means comprises:

a positioning pusher for positioning the sheet in the transverse direction by being reciprocated between an initial position and a sheet aligning position; and a rotatable feed flap for bringing the sheet into contact with the sheet front end position restricting plate by rubbing an upper face of the sheet in a front direction.

4. The sheet postprocessing apparatus according to claim 1, further comprising:

controlling means for holding a rear end portion of the sheet by driving the sheet hold flap to the sheet holding position after taking in the sheet onto the sheet table and returning the sheet hold flap to the initial position to escape from a sheet path when a successive sheet is taken in.

5. The sheet postprocessing apparatus according to claim 1, wherein, after the sheet is taken in onto the sheet table sheet by sheet and one set of the sheets is loaded on the sheet table, a postprocessing of a binding processing by a staple, a punch hole forming processing, or a binder mounting processing is carried out for the one set of sheets on the sheet table.

6. The sheet postprocessing apparatus according to claim 1, further comprising:

controlling means for driving the sheet hold flap to the sheet holding position after taking in the sheet onto the sheet table and a sheet aligning processing by the sheet aligning means.

7. The sheet postprocessing apparatus according to claim 1, further comprising:

controlling means for driving the sheet hold flap to the sheet holding position and thereafter escaping the sheet hold flap to the initial position by a constant time period.

8. The sheet postprocessing apparatus according to claim 1, further comprising:

means for detecting an amount of feeding the sheet onto the sheet table by a sheet feeding mechanism; and controlling means for returning the sheet hold flap from the sheet holding position to the initial position based on a detected value by the feed amount detecting means;

wherein the controlling means returns the sheet hold flap to the initial position when the taken-in sheet reaches immediately before the sheet hold flap.

9. A sheet postprocessing apparatus comprising:

a sheet table;

sheet aligning means for aligning longitudinal and transverse positions of a sheet taken in onto the sheet table;

a sheet hold flap arranged on an upper side of a vicinity of a rear end portion of the sheet table;

a drive mechanism for switching the sheet hold flap to an initial position of separating the sheet hold flap from the table and a sheet hold position of making the sheet hold flap proximate to the table or bringing the sheet hold flap into contact therewith;

optical detecting means or mechanical detecting means for detecting a curl amount of the sheet taken in onto the sheet table; and means for controlling to operate the sheet hold flap based on a detected value of the curl amount;

wherein the means carries out a sheet holding operation of the sheet hold flap when the curl amount of the sheet is equal to or larger than a certain reference value.

10. A sheet postprocessing apparatus comprising:

a sheet table, wherein sheets are fed frontward on the sheet table;

sheet aligning means for aligning longitudinal and transverse positions of a sheet taken in onto the sheet table; and a clamp mechanism for clamping a front end portion of the aligned sheet for a postprocessing;

wherein the clamp of the clamp mechanism includes both left and right end portions and an intermediate portion between the both left and right end portions, and wherein said both left and right end portions of the clamp are projected frontward from the intermediate portion.

11. The sheet postprocessing apparatus according to claim 10, wherein the clamp mechanism is provided at a front portion of the sheet table.

12. The sheet postprocessing apparatus according to claim 11, further comprising:

a sheet hold flap arranged on an upper side of a vicinity of a rear end portion of the sheet table.

13. The sheet postprocessing apparatus according to claim 10, wherein the sheet is taken in onto the sheet table sheet by sheet, one set of the sheets are loaded onto the sheet table, thereafter, a postprocessing of a binding processing by a staple, a punch hole forming processing, or a binder mounting processing is carried out for the one set of sheets on the sheet table.

14. The sheet postprocessing apparatus according to claim 10, further comprising:

controlling means for carrying out a clamp operation by the clamp mechanism at each time of taking in a certain set number of the sheets onto the sheet table.

15. A sheet postprocessing apparatus comprising:

a sheet table;

sheet aligning means for aligning longitudinal and transverse positions of a sheet taken in onto the sheet table;

a clamp mechanism for clamping a front end portion of the aligned sheet for a postprocessing; and controlling means for skipping a clamp operation in accordance with a number of the sheets taken in onto the sheet table;

wherein an interval of the clamp operation is reduced in accordance with an increase in the number of sheets.

16. The sheet postprocessing apparatus according to claim 10, wherein after clamping the sheet, the clamp is released after an elapse of a constant time period.

17. A sheet postprocessing apparatus comprising:

a sheet table;

sheet aligning means for aligning longitudinal and transverse positions of a sheet taken in onto the sheet table;

a clamp mechanism for clamping a front end portion of the aligned sheet for a postprocessing, wherein at each time of taking in one sheet of the sheets onto the sheet table, a clamp operation by the clamp mechanism is carried out and the clamp is released when a successive sheet is taken in; and a film provided at a lower face of the clamp of the clamp mechanism, hung to an upper face of the sheet table, and guiding a front end of the sheet taken in to the sheet table onto the sheet table.

18. The sheet postprocessing apparatus according to claim 10, wherein the clamp of the clamp mechanism is arranged at a position which does not cover a punch hole of a punched sheet on the sheet table; and wherein said both left and right end portions of the clamp are projected to vicinities of a sheet position restricting plate arranged at a front end of the sheet table.

19. The sheet postprocessing apparatus according to claim 10, wherein at each time of taking in one sheet of the sheets onto the sheet table, a clamp operation by the clamp mechanism is carried out and the clamp is released when a successive sheet is taken in.

20. A sheet postprocessing apparatus comprising:

a sheet table on which sheets are fed from a rear side to a front side;

a sheet aligning device adapted to align front-rear and right-left positions of the sheets taken in onto the sheet table;

a sheet hold flap arranged on a vicinity of a rear end portion of the sheet table; and a drive mechanism adapted to switch the sheet hold flap to an initial position of separating the sheet hold flap from the table and a sheet hold position of making the sheet hold flap proximate to the table or brining the sheet hold flap into contact therewith, wherein the sheet postprocessing apparatus is adapted such that a timing of returning the sheet hold flap to the initial position is controlled in accordance with a number of sheets on the sheet table, and a return start timing is delayed in accordance with an increase in the number of sheets so that a time period of starting from starting to take in the sheet to returning the sheet hold flap to the initial position constant regardless of the number of sheets on the sheet table.

21. A sheet postprocessing apparatus comprising:

a sheet table, on which sheets are fed from a rear side to a front side;

a sheet aligning device adapted to align front-rear and right-left positions of the sheets taken in onto the sheet table;

a clamp mechanism adapted to clamp from end portions of the aligned sheets for a postprocessing;

wherein a clamp of the clamp mechanism includes both left and right end portions and an intermediate portion between the both left and right end portions, and wherein said both left and right end portions of the clamp are projected frontward from the intermediate portion.

* * * * *